US006073638A

United States Patent [19]

Sasaki et al.

[11] Patent Number: 6,073,638

[45] Date of Patent: Jun. 13, 2000

[54] METHOD AND APPARATUS FOR CLEANING AN AUTOMOTIVE ENGINE

[75] Inventors: Mark Sasaki, Lomita; Robert C. Richardson, Yorba Linda; Michael Joseph Camacho, Rancho Cucamonga, all of Calif.

[73] Assignee: Wynn Oil Company, Azusa, Calif.

[21] Appl. No.: 09/360,713

[22] Filed: Jul. 26, 1999

Related U.S. Application Data

[63] Continuation of application No. 08/976,889, Nov. 24, 1997, Pat. No. 5,970,994.

[51] Int. Cl.[7] ..... B08B 3/04; B08B 9/00

[52] U.S. Cl. ..... 134/22.18; 134/36; 134/39; 134/102.2; 134/169 A

[58] Field of Search ..... 134/102.1, 102.2, 134/169 A, 22.18, 36, 39; 123/198 A

[56] References Cited

U.S. PATENT DOCUMENTS

| | | | |
|---|---|---|---|
| 1,801,946 | 4/1931 | Bastian . | |
| 1,874,970 | 8/1932 | Hall . | |
| 2,366,969 | 1/1945 | Kiggins | 134/102.1 X |
| 2,679,851 | 6/1954 | Schira et al. | 134/102.1 |
| 3,180,759 | 4/1965 | Falk | 134/102.1 X |
| 4,191,332 | 3/1980 | De Langis et al. . | |
| 4,573,639 | 3/1986 | Logue . | |
| 4,694,802 | 9/1987 | Lowi, Jr. | 123/198 A X |
| 4,800,848 | 1/1989 | Hubbard | 123/198 A X |
| 4,989,561 | 2/1991 | Hein et al. . | |
| 5,054,688 | 10/1991 | Gridley . | |
| 5,257,604 | 11/1993 | Vataru et al. . | |
| 5,401,324 | 3/1995 | Huddas | 134/22.18 X |
| 5,474,098 | 12/1995 | Grigorian et al. | 134/169 A |

*Primary Examiner*—Philip R. Coe
*Attorney, Agent, or Firm*—Terry L. Miller

[57] ABSTRACT

An apparatus and method for cleaning the intake system of an internal combustion engine, such as an automobile engine, employs intake manifold vacuum of the running engine to ingest and atomize a liquid cleaner using a bleed of ambient air. Atomizing of the liquid cleaner provides better dispersion of the cleaner to surfaces of the intake system of the engine, and prevents puddling of the liquid in low spots of the intake system.

9 Claims, 2 Drawing Sheets

FIG. 3.
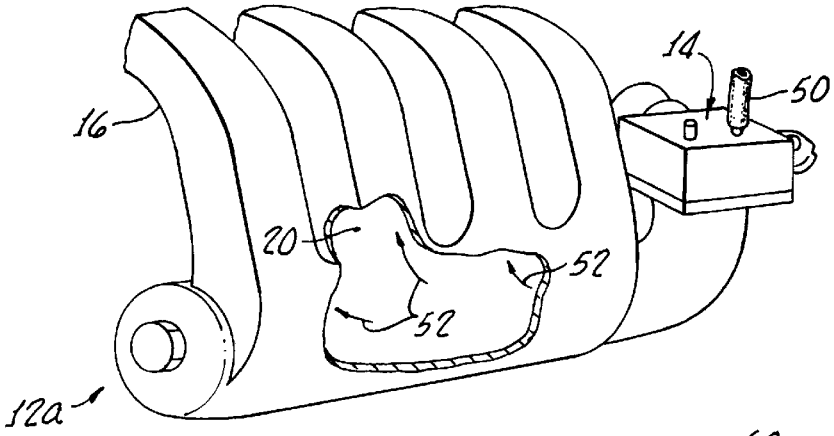
FIG. 4.
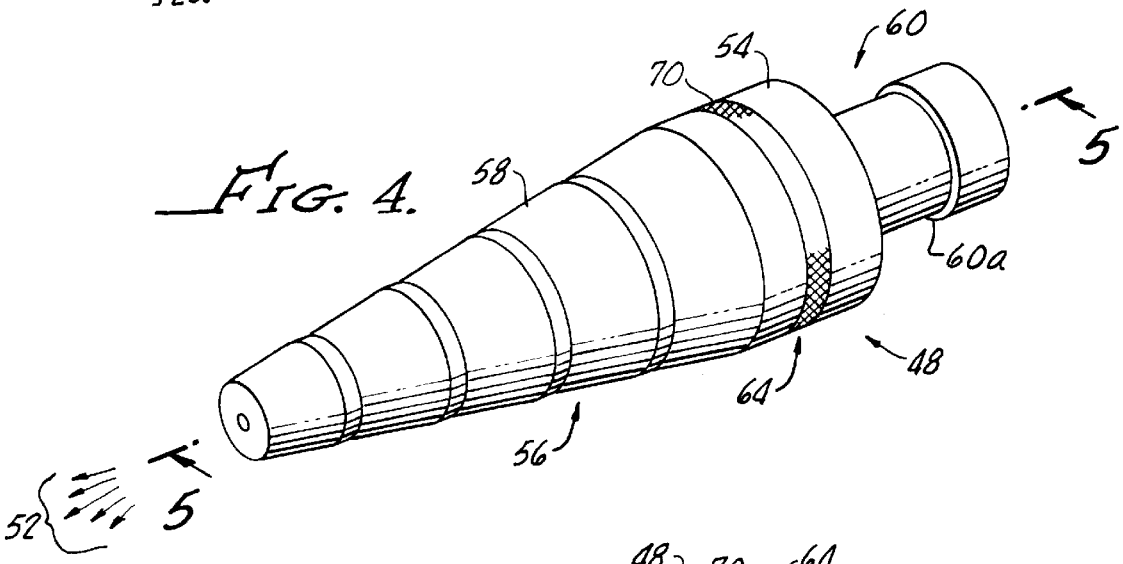
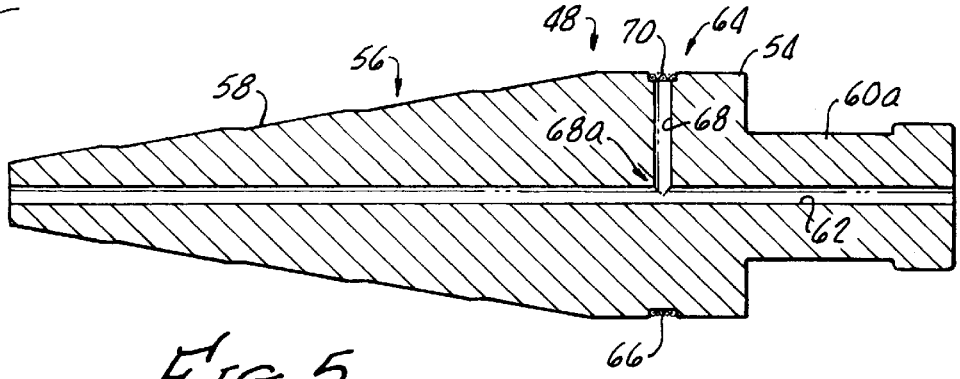
FIG. 5.

METHOD AND APPARATUS FOR CLEANING AN AUTOMOTIVE ENGINE

RELATED APPLICATIONS

This application is a divisional of U.S. patent application Ser. No. 08/976,889 filed Nov. 24, 1997, and now U.S. Pat. No. 5,970,994.

BACKGROUND OF THE INVENTION

1. Field of the Invention

The present invention is in the field of method and apparatus for cleaning internal structures and components of an automotive engine. More particularly, the present apparatus relates to a method and apparatus for cleaning the intake system, including the intake plenum, runners, and ports; and intake valves and combustion chambers of an automotive engine while the engine is assembled and running.

2. Related Technology

The cleaning of carburetors, intake systems, intake valves and combustion chambers of assembled automotive engines (i.e., without requiring disassembly of the engine) has been an objective for mechanics and the operators of automobiles almost from the beginning of the automobile itself. Carburetor cleaning spray aerosol products are very common, and are generally dispensed into the air intake of a carburetor on an engine while the engine is running. These products provide a spray of the cleaning liquid, which the user generally directs to the most soiled areas of the carburetor while applying the spray into the running engine. With products of this nature, the combination of a relatively slow rate of introduction of the liquid cleaner, and the structures of the carburetor itself against which the spray is directed (tending to break up the spray into droplets), generally prevent the accumulation of liquid in the intake system of the engine.

Other engine cleaning products of this nature have been developed in recent years which are introduced into the intake system of an automotive engine while it is running, and which are introduced via a vacuum fitting of the engine, for example. These products are generally supplied in liquid non-aerosol form, and are introduced into the running engine in liquid form using engine vacuum to draw the product into the engine. These newer products are generally more effective at cleaning an engine than the older conventional and aerosol products, but also have a problem in that distribution of the cleaning product among the several intake runners, intake ports, intake valves and combustion chambers of a multi-cylinder engine is not uniform. In other words, some of the cylinders of an engine cleaned in this way may receive an excess of the cleaning product, while other cylinders of the engine receive less of the cleaner, or virtually none at all. Understandably, an engine will not be cleaned satisfactorily if a liquid cleaner product is not distributed with a substantial degree of uniformity within the intake system and among the cylinders of the engine.

Further, a problem with some automotive engines is that the cleaner is introduced at a rate sufficient in some cases to cause liquid puddling in the intake systems of the engines. Generally, these engine cleaning products are introduced in liquid form by engine intake manifold vacuum, which draws the liquid from a dispensing container via a connecting hose or conduit. A metering orifice may be disposed in the liquid flow path to limit the rate at which the cleaning liquid is drawn into the engine by engine vacuum. Moreover, in most engine designs these newer cleaning products cause no problem because the cleaner is broken up into droplets, and is drawn into the combustion chambers of the engine without accumulating to any large extent. However, some engine designs, for example, those with an intake manifold floor or plenum floor which at least in part is lower than the intake valves of the engine can experience difficulty with such engine cleaner products. That is, a persistent problem with some designs of automobile engines when such products are used has been the puddling of cleaning liquid in the intake manifold of the engine. In other words, some engine designs are such that the intake manifold offers low areas or recesses where significant quantities of cleaning liquid can accumulate even though the liquid is introduced while the engine is running.

Further, the air flow in the intake system of an engine while idling or at a speed slightly above idle (which is ordinarily the case while the cleaner is being introduced) is generally not sufficient to either move the puddled liquid to a combustion chamber, or to vaporize the liquid. This problem may be worsened if the engine is not properly warmed up prior to use of the cleaner. In such cases, the intake manifold is cool, and the liquid cleaner is not as readily vaporized.

In cases resulting in puddling of the cleaning liquid in the intake manifold of an engine, subsequent racing of the engine or moving of the automobile, for example can result in liquid from the puddle being sloshed or drawn by engine air flow into one or more of the combustion chambers of the engine while it is running. In such an event, if a quantity of liquid cleaner is drawn into a combustion chamber and is sufficient to completely fill the clearance volume of the chamber, hydraulic locking of the engine results. That is, serious damage to the engine can result when a piston of the running engine approaches the engine head and is blocked by a quantity of essentially incompressible liquid. Operation of the running engine is then brought suddenly to a stop, with possible internal damage to the engine.

In view of the above, it would be desirable to provide a method and apparatus for introducing a liquid cleaner into the intake system of an automotive engine while it is running, and while reducing or eliminating the possibility for the liquid leaner to puddle in the intake system of the engine.

SUMMARY OF THE INVENTION

In view of the above, it is an object of this invention to provide a method and apparatus for introducing a liquid cleaner into the intake system of a running engine, and which reduces or eliminates the possibility for the liquid cleaner to puddle in the engine.

Further, an object of this invention is to provide such a method and apparatus which introduces a liquid cleaner into the intake system of an engine at a controlled rate.

Still another object for this invention is to provide a method and apparatus of introducing a liquid cleaner into a running engine, and which uses the intake manifold vacuum of the running engine to draw in the liquid cleaner.

Yet another object for this invention is to provide such a method and apparatus, in which ambient air is ingested along with a liquid cleaning material, and the ambient air is utilized to atomize the liquid and provide an atomized "fog" of the cleaning liquid to a running automotive engine.

Accordingly, one aspect of the present invention provides an apparatus for cleaning the intake system of an automotive internal combustion engine providing intake manifold vacuum when operating. This apparatus comprises: a source of liquid cleaner to be introduced into the intake system of the engine; a conduit extending between said source and said engine to convey said liquid cleaner; an aspirator communicating between said conduit and intake manifold vacuum of said engine for atomizing said liquid cleaner and introducing said atomized liquid cleaner into said intake system, said aspirator including an ambient air intake port aspirating ambient air and mixing said ambient air with said liquid cleaner to atomize the latter.

Another aspect of the present invention provides a method for cleaning the intake system of an automotive internal combustion engine utilizing ambient air bleed and intake manifold vacuum of the operating engine to ingest a liquid cleaner in atomized form. This method comprises steps of: providing a source of liquid cleaner to be introduced into the intake system of the engine; and utilizing an aspirator communicating said liquid cleaner into said intake system to atomize said liquid cleaner while introducing said liquid cleaner into said intake system.

Additional objects and advantages of the present invention will appear from a reading of the following description of a single exemplary embodiment of the invention taken in conjunction with the appended drawing Figures, in which like reference numerals indicate the same feature throughout the drawing Figures, or indicate features which are analogous in structure or function.

BRIEF DESCRIPTION OF THE DRAWINGS FIGURES

Figure 1:
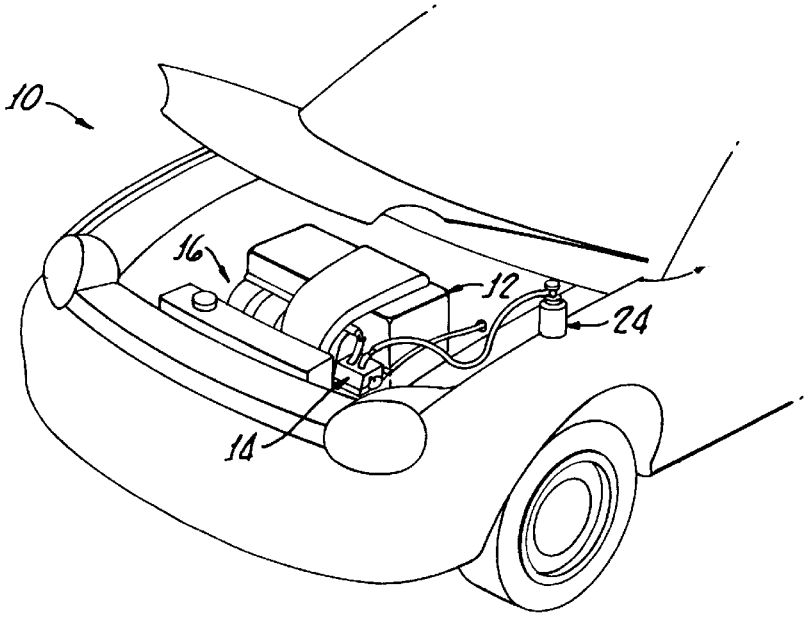
FIG. 1 is a pictorial representation of an automotive vehicle, and the engine of this vehicle.
Figure 2:
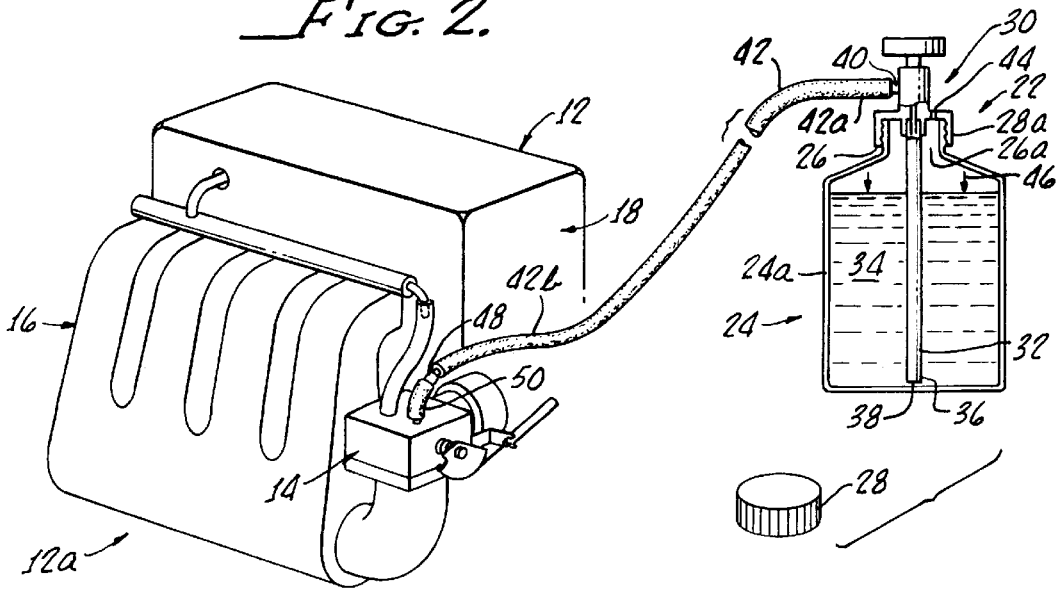
FIG. 2 is a fragmentary illustration of a part of the engine of the vehicle seen in FIG. 1, and shows this engine being cleaned using a method and apparatus embodying the present invention.

FIG. 3 provides a fragmentary view, partially in cross section, of an intake manifold of the engine seen in FIGS. 1 and 2, which intake manifold defines a portion of the intake system for this engine, and which is being cleaned using the method and apparatus of the present invention; and FIGS. 4 and 5 respectively are an enlarged fragmentary and cross sectional views of a portion of the engine cleaning apparatus seen in FIGS. 2–4.

DETAILED DESCRIPTION OF AN EXEMPLARY PREFERRED EMBODIMENT OF THE INVENTION

Viewing first FIG. 1, an automotive vehicle 10 is seen having an engine 12. In this case, the automotive vehicle 10 is an automobile, although it is to be understood that the invention is not limited to use on automobiles. For example, the invention may be used to clean the engine of a truck, a vans, or even of a boat. Further, it is to be understood that the invention is not limited to cleaning engines of automotive vehicles. For example, a stationary engine (such as the engine of a motor-generator set) may be cleaned using the present invention. Further, an engine which is not stationary, but which is also not a propulsion engine for an automotive vehicle may be cleaned using the present invention. For example, many industrial air compressors which are portable (such as may be used at a construction site) have internal combustion engines, and these engines may be cleaned using the present invention. Accordingly, it is to be understood that a wide variety of internal combustion engines may be cleaned by use of the present invention. The only requirement is that the engine develop an intake manifold vacuum while it is running at or slightly above idle speed. Thus, the invention is not used to clean a diesel engine. However, even engines which are turbo-charged, for example, and which may operate with a supra-ambient intake manifold pressure under load at speeds above idle, may be cleaned using the present invention. Such is the case because turbo-charged engines operate with a manifold vacuum at idle and at speeds somewhat above idle when the engine is not under load.

Considering now the illustration of FIG. 2, the engine 12 is seen to have a throttle body 14 admitting air to an intake manifold 16, conducting the air to intake ports (not shown) formed within a head 18 of the engine 12. The throttle body 14, and passages 20 defined internally of the intake manifold, along with the intake ports of the engine head 18 are cooperatively referred to generally as the intake system 12*a* of the engine 12. Within the head 18 it will be understood that the engine 12 includes intake poppet valves (not shown) which controllably open and close the intake ports. This aspect of the structure and operation of the engine 12 will be well understood to those ordinarily skilled in the pertinent arts. Viewing now FIGS. 2–4 in conjunction with one another, it is seen that the intake system of the engine 12 is being cleaned (while the engine is running at or preferably slightly above idle speed) by use of a cleaning apparatus 22. The cleaning apparatus 22 includes a container 24, which in this case takes the form of a can 24*a* with a threaded neck 26 defining an opening 26*a*. As depicted in the drawing Figures, the cap 28 which closed the opening 26*a* during shipping of the can 24*a* has been removed. Threaded into place on the neck 26 in place of cap 28 is a dispenser assembly 30. This dispenser assembly 30 includes a suction tube 32 extending downwardly into a liquid cleaning material 34 (i.e., the "cleaner") to terminate at a lower end 36 adjacent bottom of the can 24*a*, and there having an opening 38. The dispenser assembly 30 also includes an outwardly disposed hose barb 40 communicating with the suction tube 32, and to which a proximal end portion 42*a* of an elongate flexible conduit (or hose) 42 is attached. The dispenser assembly 30 also defines an air bleed opening 44 admitting ambient air to the container 24. Thus, as is depicted by arrows 46, ambient air exerts a pressure force on the liquid cleaner 34 in container 24.

At its distal end portion 42*b*, the hose 42 is connected to an aspirator fitting, generally indicated with the numeral 48. In the illustrated case, the aspirator fitting 48 is connected to a PCV valve (i.e., positive crankcase ventilation) hose 50, which has been temporarily disconnected to allow the engine 12 to be cleaned. Those ordinarily skilled in the pertinent arts will understand that the fitting 48 need not be installed into access with the intake system 12*a* via a PCV hose. Any convenient and accessible fitting or connection of sufficient size which opens into the intake system 12*a* so as to have intake manifold vacuum during operation of the engine 12 will be acceptable for this purpose.

As is seen in FIGS. 2–5, during operation of the engine 12, the aspirator fitting 48 provides a mist or "fog" (indicated with arrowed numeral 52) of the liquid cleaner 34. As is easily understood, this mist or fog 52 is easily and effectively moved along the intake system 12*a* into the combustion chambers (not shown) of the engine 12, so that very little or none of the liquid cleaner 34 puddles in the intake system 12*a* regardless of its shape, configuration, or the presence of low areas in this intake system 12*a*. Moreover, the liquid cleaner 34 is not introduced as a liquid stream, or even as coarse droplets, into the intake system 12*a*, but is instead efficiently "fogged" into the engine to substantially eliminate the puddling problem explained above. Consequently, the risk of hydraulic lock of engine 12 because of a mass of liquid cleaner 34 being drawn at once into a combustion chamber of the engine 12 is substantially eliminated. Further, it is believed that the "fogging" of the cleaner 34 into the intake system 12*a* of the engine 12 will result in a more effective distribution of the cleaner 34 to the surfaces of this system, as well as to the surfaces of the intake valves and combustion chambers of the engine 12.

In order to provide the fogging function for cleaner 34 as discussed above, the aspirator fitting 48 includes a body 54 which along a forward exterior portion 56 thereof defines a stepped or alternatingly conical and cylindrical surface, generally indicated with the numeral 58. The surface 58 thus provides a wide variety of diameters which may be connected conveniently to a fitting or hose leading into the intake system 12*a* of the engine 12. A rear portion 60 of the body 54 defines a hose barb feature 60*a*, to which the hose 42 connects. Extending lengthwise through the body 54 is a central bore 62. Preferably, this bore 62 is of a size to control the rate of introduction of liquid cleaner 34 under the intake manifold vacuum existing in engine 12 during operation at idle speed or at a speed slightly above idle speed. Most preferably, the through bore 62 is 0.037 inches in diameter. Intermediate of the portions 56 and 60, the body 54 also defines an air intake section, indicated with numeral 64.

Preferably, the air intake section 64 is cylindrical, with a circumferential groove 66. From the groove 66 a lateral air intake bore 68 extends to the through bore 62. The bores 62 and 68 have an intersection indicated by arrowed numeral 68*a*. Preferably, this intersection 68*a* is one with coincident centerlines and at a perpendicular angle. However, the invention is not so limited. For example, an angulation of the bore 62 toward or against the direction of flow of liquid cleaner 34 to engine 12 may assist in atomizing this cleaner. Similarly, the bore 68 may be arranged to intersect with bore 62 somewhat in a tangential direction so that a swirl is introduced into the liquid cleaner and air which together flow from the intersection 68*a* toward the engine 12 within the fitting 48. The size of the bore 68 is most preferably 0.041 inches in diameter.

The size of this bore 68 is important for a number of reasons. First, the size of bore 68 is important because it influences the amount of engine vacuum communicated to the container 24, thus affecting the rate at which cleaner 34 is drawn from this container into the engine 12. Further, the size of bore 68 affects the amount of ambient air drawn into the engine 12 via the fitting 48, and thus affects the degree to which the speed of the engine 10 is elevated above idle speed by virtue of this air bleed (and without an adjustment of the idle speed control screw of the engine or control of throttle position by a person at the driver's controls of the car 10). Further, the combination of the rate of feed of liquid 34 from container 24 and the rate of intake of ambient air via bore 68 is affected by the sizes of these two bores, thus affecting the atomizing of the liquid 34 effected by the aspirator fitting 48.

In order to protect the fitting 48 against ingestion of grit and dirt which may be present in the environment around the engine 10, the body 54 is fitted with a collar 70 of mesh or filter material.

In use of the cleaning apparatus 22, a user opens a container 24*a* of the cleaner 34 by removing the cap 28, and replace the cap with the dispenser assembly 30. The hose 42 from the dispenser assembly 30 connects with the fitting 48, and this fitting is associated with the engine 10 so that it communicates with intake manifold vacuum when the engine 10 is running. As explained above, one way in which this connection may be effected is to temporarily disconnect the PCV valve hose of the engine 12, and connect the fitting 48 into this hose. The fitting 48 is thus inserted into a PCV hose or other connection to intake manifold vacuum and receives manifold vacuum at the through bore 62 when the engine 10 is started. After this preparation, the user starts the engine 10, and the intake manifold vacuum is communicated both to container 24*a* and to the ambient air bleed bore 68. As explained above, liquid from container 24*a* is drawn from container 24*a* via dispenser assembly 30 and hose 42, and along bore 62 to the intersection 68*a*. Downstream of the intersection 68*a* (that is leftwardly, viewing FIG. 4), the liquid cleaner 34 and ambient air drawn in via bore 68 form an aerosol liquid and air together. As this aerosol is admitted into the intake manifold of engine 12, a fog or mist of liquid 34 is formed, as noted above. The additional ambient air admitted to the intake manifold 16 via fitting 48 assists in insuring that the operational speed of the engine 12 during the cleaning operation is about 1500 RPM (i.e., slightly above normal idle speed for most automotive engines). The user who is conducting the cleaning operation may find it necessary to make a temporary adjustment to an idle speed control screw of the throttle body 14, or to simply apply a slight movement to the throttle pedal of the vehicle 10 during the cleaning operation. Consequently, the cleaning liquid 34 is fogged or misted into the manifold 26 of the engine 12, and the interior surfaces of this manifold, the intake valves, and combustion chambers of the engine are cleaned and de-carbonized.

An advantage of the present invention is dramatically illustrated by a comparison of the amount of liquid cleaner which may be recovered from the intake manifold of a vehicle which is particularly susceptible to puddling. In tests of such a vehicle a conventional metering orifice apparatus was used to feed in 473 ml. of a liquid cleaner 34. Immediately after the feeding in of this liquid cleaner, the engine was stopped, and the intake manifold was inspected for puddled liquid. Test results varied from about 300 ml. to as much as 350 ml. of liquid was recovered from the intake manifold. Most automotive sized engines will be hydraulically locked by about 100 ml. of liquid if this liquid is drawn into a combustion chamber of the engine.

In contrast, with the same vehicle and same amount of liquid cleaner (i.e., 473 ml.), the inventive apparatus and method here described resulted in only 20–40 ml. of recovered liquid when the engine speed was kept in the 1500–2000 RPM range during the cleaning process. As can readily be seen, the inventive apparatus and method eliminated the possibility for the vehicle engine to be damaged by hydraulic locking. Further, as mentioned above, it is believed that the dispersal of the cleaner liquid 34, and the effectiveness of the cleaning process performed, is improved by the "fogging" of the cleaner by the present method and apparatus. Thus, it is seen to be an advantage to use the present method and apparatus for all cars, even those which have no tendency to accumulate a puddle of liquid cleaner in their intake system.

While the present method and apparatus has been depicted, described, is defined by reference to one particularly preferred exemplary embodiment of the invention, the invention is not so limited. The invention is capable of considerable modification and variation, which may occur to those ordinarily skilled in the pertinent arts. For example, it will appear that other and differing apparatus may be used to disperse, fog, or atomize the liquid cleaner 34 so as to provide for its introduction into the intake system of an automotive engine using ambient air and engine vacuum to achieve this result. A small carburetor apparatus which is temporarily communicated with the intake manifold of the vehicle being serviced might suffice for this purpose.

What is claimed is:

1. A service method for cleaning the intake system of an automotive internal combustion engine temporarily utilizing ambient air bleed and intake manifold vacuum of the operating engine to temporarily ingest a liquid cleaner in atomized form during said service, said method comprising steps of:

providing a source of liquid cleaner to be introduced into the intake system of the engine temporarily during said service;

temporarily utilizing an aspirator communicating said liquid cleaner into said intake system to atomize said liquid cleaner while introducing said liquid cleaner into said intake system during said service; and completing said service by removing said source of liquid cleaner and also removing said aspirator from communication into said intake system.

2. The method of claim 1 further including the steps of providing said aspirator with a bore of determined diameter, and flowing liquid cleaner along said bore of determined diameter to said intake system while utilizing said bore of determined diameter to define a metering orifice for said liquid cleaner.

3. The method of claim 2 further including the steps of providing said aspirator with an ambient air intake bore of certain diameter, utilizing said ambient air intake bore to define an opening to ambient at which said ambient air intake port is defined, and utilizing said ambient air intake bore of certain diameter to define a metering orifice for ambient air flow into said intake system via said aspirator while said engine is in operation.

4. A service method of atomizing a liquid engine cleaner into an intake system of a running internal combustion engine which is not producing usable power but does produce an intake manifold vacuum in said intake system, said service method comprising steps of:

using said intake manifold vacuum to ingest ambient air along a first flow path into said intake system;

using said intake manifold vacuum to ingest said liquid engine cleaner along a second flow path into said intake system while said engine operates substantially at a fast-idle speed;

intersecting said first and said second flow paths to mix said ambient air and said liquid engine cleaner before introduction into said intake system;

flowing said mixed ambient air and liquid cleaner together toward said intake system; and using the mixing of said ambient air and said liquid engine cleaner to atomize the latter into a fine, substantially non-precipitating fog upon introduction together into said intake system; and discontinuing ingestion of ambient air and said liquid engine cleaner before returning said internal combustion engine to power-producing use.

5. A method of substantially preventing puddling of liquid engine cleaner in the intake manifold of an internal combustion engine during a temporary service procedure to clean said intake manifold, said method comprising steps of:

providing a source of liquid engine cleaner to be introduced into the intake manifold of the engine while said engine is substantially at a fast-idle speed and is not producing usable power; and utilizing an aspirator communicating both said liquid engine cleaner and ambient air into said intake manifold to atomize said liquid cleaner while introducing said liquid engine cleaner into said intake manifold as an atomized substantially non-precipitating mist.

6. The method of claim 5 further including the steps of forming said aspirator with a body having a through bore of determined diameter, flowing said liquid engine cleaner from said source to said intake manifold along said through bore, and utilizing said through bore of determined diameter to define a metering orifice for said liquid engine cleaner.

7. The method of claim 6 further including the steps of providing said aspirator body with an ambient air intake bore of certain diameter, utilizing said ambient air intake bore to define an opening to ambient, defining at said opening to ambient an ambient air intake port, and utilizing said ambient air intake port to define a metering orifice for ambient air flow into said intake manifold via said aspirator.

8. The method of claim 7 further including the steps of providing said aspirator body with an end portion of tapering outer diameter, and defining at said end portion of tapering outer diameter a plurality of gradated substantially cylindrical diameter sections spaced along a length of said aspirator body.

9. A service method for cleaning the intake system of an automotive internal combustion engine while the engine is operating at a fast-idle speed, is providing intake manifold vacuum, and is not producing usable power, said method comprising steps of:

providing a source of liquid cleaner to be temporarily introduced into the intake system of the engine during said service;

providing an aspirator and communicating said liquid cleaner and ambient air via this aspirator into said intake system while simultaneously atomizing said liquid cleaner into a substantially non-precipitating fog;

continuing said service for the duration of time sufficient that a selected quantity of liquid cleaner is ingested by said engine, and completing said service by removing said source of liquid cleaner and also removing said aspirator from communication into said intake system.

* * * * *